United States Patent [19]

Sorger

[11] 4,366,952

[45] Jan. 4, 1983

[54] IMMERSION-LANCE FOR INTRODUCING A FINELY DIVIDED, PARTICULATE SOLID MATERIAL INTO A METAL MELT

[75] Inventor: Heino Sorger, Winsen, Fed. Rep. of Germany

[73] Assignee: Klockner Stahltechnik GmbH, Hamburg, Fed. Rep. of Germany

[21] Appl. No.: 263,220

[22] Filed: May 13, 1981

[30] Foreign Application Priority Data

Jun. 7, 1980 [DE] Fed. Rep. of Germany ..... 3021523

[51] Int. Cl.[3] ..... C21B 7/16

[52] U.S. Cl. ..... 266/266; 75/60; 266/225; 266/226

[58] Field of Search ..... 266/266, 225, 226; 75/60

[56] References Cited

U.S. PATENT DOCUMENTS 4,022,447 10/1977 Griffiths ..... 266/266

FOREIGN PATENT DOCUMENTS 7509076 1/1976 Fed. Rep. of Germany .

*Primary Examiner*—P. D. Rosenberg

*Attorney, Agent, or Firm*—Sherman & Shalloway

[57] ABSTRACT

The invention concerns an immersion-lance for introducing a finely-particulate solid material into a metal melt, by means of a carrier gas, the internal diameter of the lance being narrowed in the region of the outlet opening. The object in the invention is to produce a lance which is suitable both for the transport of solid material and for flushing with gas. This is achieved by the features that the lance (1) contains a restrictor (8) which can be moved coaxially with the outlet opening (3), this restrictor being located, in a first end position, at a distance from the outlet opening (3) such that an open cross-section remains which is suitable for the transport of the solid material, and this restrictor being located, in a second end position, so that it narrows the outlet opening to a cross-section suitable for the transport of the gas. When the restrictor is located in the second end position, it narrows the outlet opening to a residual cross-section which is so small that the desired quantity of gas passes through the residual cross-section at a pressure, or velocity, such that the molten material is prevented from penetrating.

7 Claims, 2 Drawing Figures

Figure 1:
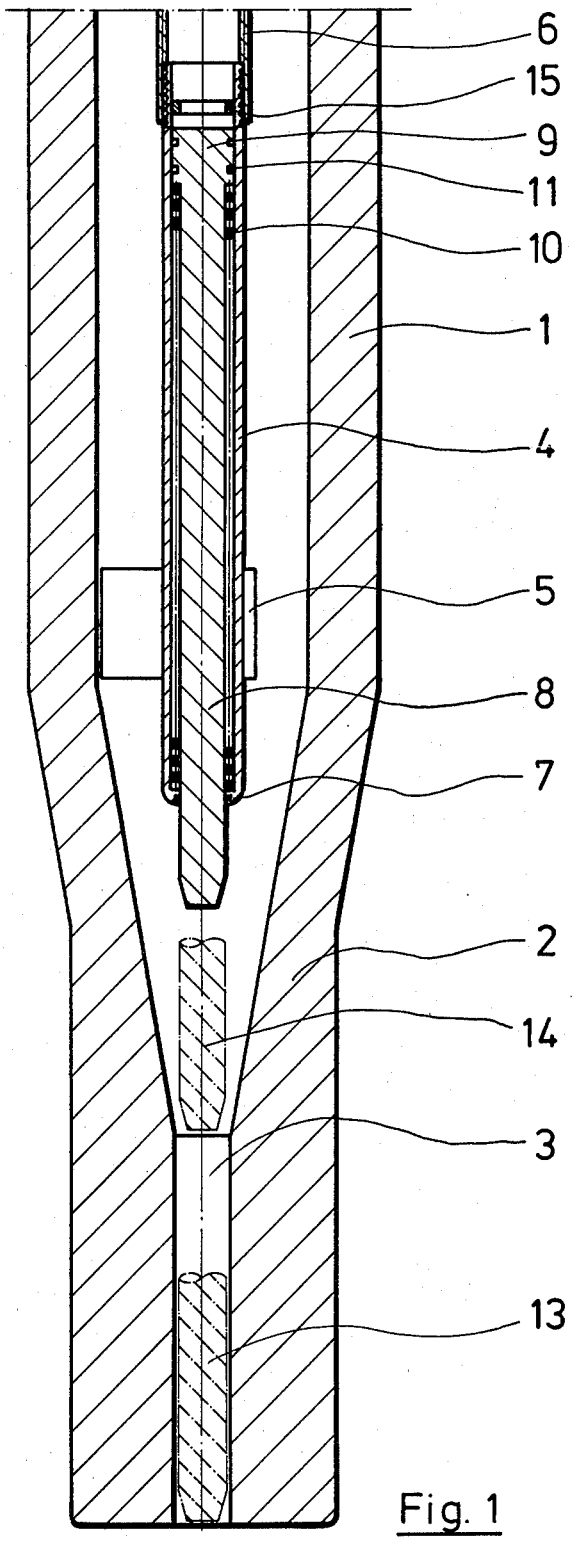

IMMERSION-LANCE FOR INTRODUCING A FINELY DIVIDED, PARTICULATE SOLID MATERIAL INTO A METAL MELT

The invention relates to an immersion-lance for introducing a finely-particulate solid material into a metal melt by means of a carrier gas, the internal diameter of the lance being narrowed in the region of the outlet opening.

Known immersion-lances of this type (German Auslegeschrift No. 2,528,672) are suitable exclusively for the transport of solid material by means of a carrier gas. If it is intended to transport gas alone (for example flushing-argon), another lance must be used. The cross-section of the outlet opening of the lance provided for transporting solid material is, of course, too large for the transport of the gas, with the result that, when gas is being transported, the gas velocity would either be too low, so that molten material could penetrate into the outlet opening, or that the gas would emerge with such violence that the melt is thereby agitated to an excessive degree.

The object underlying the invention is to produce a lance which is suitable both for the transport of solid material and for flushing with gas.

This problem is solved, according to the invention, by arranging for the lance to contain a restrictor which can be moved coaxially with the outlet opening, this restrictor being located, in a first limiting position, at a distance from the outlet opening such that an open cross-section remains which is suitable for the transport of the solid material, and this restrictor being located, in a second limiting position, so that it narrows the outlet opening to a cross-section suitable for the transport of the gas. The restrictor advantageously has the shape of a rod. The tip of the restrictor can have any shape which is suitable for forming a suitable flow cross-section. The tip need not accordingly be cylindrical. For example, the tip can be designed in the form of a hemisphere, a convex body, or a cone.

When the restrictor is located in its limiting position remote from the outlet opening, the lance can be used in the customary manner for the transport of solid material. When the restrictor is located in its other limiting position, it narrows the outlet opening to a residual cross-section which is so small that the desired quantity of gas passes through this residual cross-section at a pressure, or velocity, such that the molten material is prevented from penetrating.

Provision can also be made, according to the invention, for designing the restrictor to be adjustable in intermediate positions between these limiting positions, for the purpose of regulating the transport stream of solid material.

The adjustment of the restrictor can be brought about by means of mechanical actuating-members (for example by threaded spindles), which project into the lance from behind. However, it is more advantageous to arrange a piston and cylinder device inside the lance, this device being capable of mechanical connection to the restrictor in order to move it. This arrangement is expediently designed in such a manner that the restrictor is pushed, by the force of a spring, into the limiting position remote from the outlet opening, and can be moved into the other limiting position by applying pressure to the piston and cylinder device, against the spring force. This design results in very reliable adjustability of the restrictor, because the spring force can easily be proportioned in such a way that it securely holds the restrictor in the retracted position and, as the case may be, can withdraw it from its extended position, whilst the actuating pressure for the piston and cylinder device can easily be proportioned in such a way that it not only overcomes the spring force, but also overcomes all forces which could conceivably resist the pushing of the restrictor into the outlet opening.

The arrangement of a piston and cylinder device inside the lance has the additional advantage that a device of this type can be used to form a guide arrangement for the restrictor, or to form at least a part of such a guide arrangement.

Should additional cooling of the restrictor appear to be necessary, provision can be made for the restrictor to contain a passage, or a plurality of passages, through which the gas to be transported flows when the restrictor is located in the extended position inside the outlet opening of the lance. A passage of this type can start from the pressure chamber of the piston and cylinder device. In such a case, the gas to be transported is applied to the piston and cylinder device. However, the passage can also be led from the interior of the lance which has a comparatively large diameter, to the tip of the restrictor.

Figure 2:
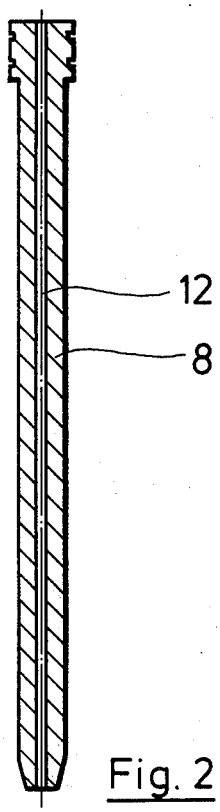

In the text which follows, the invention is explained in more detail by reference to the drawing, which represents an advantageous illustrative embodiment and in which:

FIG. 1 shows a partial longitudinal section through the tip of a lance which is equipped according to the invention, and FIG. 2 shows an alternative design of a restrictor.

The lance-tube 1 and its tip region 2, with the outlet opening 3, can be designed in the known manner, for example as illustrated and explained in German Auslegeschrift No. 2,528,672. In the tip region 2, the internal diameter of the lance-tube decreases to the cylindrical cross-section of the outlet opening 3.

A tube 4 is positioned concentrically inside the lance-tube 1, in a manner permitting replacement but in an axially fixed location when in the assembled position, this tube being held by means of a centring device, at 5, coaxially with the outlet opening 3. Additional centring devices can be provided in the rear region of the lance, which is not shown. At its rear end, the tube 4 is secured inside a supply tube 6, which also functions as a retaining tube. At its front end, the tube 4 forms a collar 7 which projects inwards and contains a sealing-ring, which interacts with the restrictor 8, the latter being designed in the form of a cylindrical rod. At its rear end, this restrictor is mechanically attached, in a rigid manner, to a piston 9. The resistor can itself also possess at its rear end a piston-shoulder 11 which, if desired, is provided with a seal. A spiral compression-spring 10 is provided between the piston-shoulder 11 and the collar 7 which projects inwards, this spring pushing the restrictor into the rear limiting position shown, against the stop 15, in which position the internal cross-section of the lance-tube 1 is open for the transport of the solid material. If now pressurised gas or hydraulic fluid is applied to the tubes 4, 6, which, with the piston part 9, 11 form a piston and cylinder device, the restrictor is pushed forwards whilst the spring is correspondingly compressed. If the pressure is high enough to overcome the spring force completely, the restrictor moves into the front limiting position, indicated by dot/dash lines at 13, in which the open cross-section of the outlet opening is closed with the exception of a small annular gap, and is thereby rendered suitable for the transport of the gas. The annular gap results from the difference in diameter between the restrictor and the outlet opening, this difference in diameter being proportioned according to the desired gas flow-rate, the prevailing pressure conditions, and the desired gas velocity.

If, however, the actuating-device is suitably designed, it is also possible to secure the restrictor in intermediate positions, of which one is indicated by a dot/-dash line at 14. In this position, the tip of the restrictor is located in the conically narrowing region 2 of the lance-tube, so that a cross-section remains, between the restrictor and the inside wall of the lance-tube, which lies between the cross-sections assigned to the respective limiting positions. Such intermediate positions are selected if it is desired to restrict the flow of solid material, or if the mean density of the transported stream gradually decreases during the transition from the transport of solid material to the transport of flushing gas.

In this connection, it should be noted that the expression "transport of gas" should not, in connection with the invention, be taken to mean that the transported gas may not contain any solid materials whatever; on the contrary, the point is that the density of the gas stream, taking account of any solid materials which may be contained therein, is only insignificantly lower than the density of the transported stream when transport of the solid material is taking place.

FIG. 2 shows an embodiment of the restrictor with a cooling passage 12, which leads from the pressure chamber of the piston and cylinder device 4, 9 to the tip of the restrictor. When the restrictor is held in its front position by applying pressure to the piston and cylinder device, pressurised gas or hydraulic fluid from the piston and cylinder device penetrates, through the passage 12, to the tip of the restrictor and cools it.

What is claimed is:

1. An immersion lance for introducing a fine particulate solid material into a metal melt by means of a carrier gas comprising a hollow outer tube having a main portion and an end portion, said end portion being tapered so that the internal diameter of said end portion is reduced towards the outlet of said end portion; and a restrictor having a constant diameter and disposed within said outer tube and movable along the longitudinal axis of said outer tube to vary the diameter of the outlet in said end portion of said outer tube to permit the flow of gas or gas-particulate mixture therethrough by adjusting the position of said restrictor.

2. The immersion lance of claim 1 wherein said restrictor is in the shape of a rod.

3. The immersion lance of claim 1 wherein a piston and cylinder device is provided inside said lance, said device being connected to said restrictor in order to move said restrictor.

4. The immersion lance of claim 3 wherein a spring is provided within said lance to urge said restrictor away from the outlet of said outer tube to allow flow of gas-particulate mixture and the force of said spray can be overcome by applying pressure to the piston and cylinder device so that the restrictor is disposed within the outlet in the end portion of said outer tube to allow gas flow only.

5. The immersion lance of claim 3 wherein said piston and cylinder device forms one part of a guide arrangement for the restrictor.

6. The immersion lance of claim 1 wherein said restrictor is provided with at least one internal passage through which the medium to be transported can flow.

7. The immersion lance of claim 1 wherein a device is provided within said outer tube to center said restrictor.

* * * * *